US005291831A

United States Patent [19]

Carney et al.

[11] Patent Number: 5,291,831

[45] Date of Patent: Mar. 8, 1994

[54] BENEFICIAL USE OF CLASS 1.1 ROCKET PROPELLANT

[76] Inventors: Patrick L. Carney, 1080 Nowata, Dubuque, Iowa 52202; Robert W. Perry, 16785 Gallop Dr., Morgan Hill, Calif. 95037

[21] Appl. No.: 38,773

[22] Filed: Mar. 30, 1993

[51] Int. Cl.[5] ..... F42B 3/00; C06C 5/04

[52] U.S. Cl. ..... 102/318; 149/124; 86/22; 102/275.4

[58] Field of Search ..... 149/108.4, 124; 102/318, 275.4; 86/22

[56] References Cited

U.S. PATENT DOCUMENTS

| | | | |
|---|---|---|---|
| 3,968,723 | 7/1976 | Falterman et al. | 86/1 A |
| 4,012,245 | 3/1977 | Voight, Jr. et al. | 149/19.4 |
| 4,276,100 | 6/1981 | Colvin et al. | 149/109.6 |
| 4,376,666 | 3/1983 | Williams, Jr. | 149/109.6 |
| 4,661,179 | 4/1987 | Hunter et al. | 149/124 |
| 4,853,051 | 8/1989 | Bennett et al. | 149/19.4 |
| 4,956,397 | 9/1990 | Rogowski et al. | 523/138 |

OTHER PUBLICATIONS

Thomas et al., U.S.S.I.R. #H203, Feb. 3, 1987.
Mitchell et al., U.S.S.I.R. #H305, Jul. 7, 1987.

*Primary Examiner*—Peter A. Nelson
*Attorney, Agent, or Firm*—McAulay Fisher Nissen Goldberg & Kiel

[57] ABSTRACT

The present invention describes a method of using 1.1 solid rocket propellant in the detonation process for explosives. The use of the 1.1 solid rocket propellant is described as a booster for use in a blasting cap.

20 Claims, No Drawings

BENEFICIAL USE OF CLASS 1.1 ROCKET PROPELLANT

TECHNICAL FIELD OF THE INVENTION

The technical field to which this invention relates is the beneficial use of solid rocket propellant materials as a booster in a detonator system for use in the blasting industry. More specifically, to a method of utilizing excess or demilitarized Class 1.1 propellant which might otherwise be wasted.

BACKGROUND OF THE INVENTION

In the past several decades substantial technology has been developed for the formulation of solid propellant materials suitable for use in rocket motors for the propulsion of launch systems and their military and civilian payloads. The principal objective in connection with the engineering and development of propellant formulations that are suitable for solid rocket motors is to combine oxidizer and fuel ingredients in a ratio such that when the propellant is burned there is little or no residual fuel or oxidizer remaining; any such material that is not consumed affects the payload capability of the system.

In the course of normal manufacturing processes of solid propellants, a certain amount of excess or scrap propellant is produced. This unique, highly-engineered material is a resource which can be put to beneficial use; however, in the past this high quality material has been wasted through burning, incineration and the like. For example, propellant from defective rocket motors, and propellant from over-aged rockets were destroyed by thermal treatment such as open air burning. In addition a substantial quantity of Class 1.1 propellant product presently exists in the form of military, solid-rocket motors that are destined for demilitarization and destruction; this resource can be conserved by utilizing the Class 1.1 propellant in accordance with the present invention.

Therefore, the present invention is directed towards utilizing this uniquely engineered material as a resource instead of wasting it by open burning or the like which could impact the environment.

The present invention provides for a method which his environmentally sound and cost-effective for utilizing this unique resource of high-energy, solid-propellant, rocket material as a useful product for the blasting industry.

BRIEF DESCRIPTION OF THE INVENTION

The present invention is for a method of utilizing Class 1.1 solid propellant material as the booster in the detonator system for use by the blasting industry in bore hole blasting, widely used in the mining and quarrying industries, and for a variety of other blasting activities such as tunnel boring.

In the blasting industry, typically a pattern of bore holes are drilled in preparation for blasting the rock to a free face. The bore hole is filled with suitable explosive such as ANFO, water gels, emulsions, etc. which detonate or deflagrate to provide substantial forces for breaking the rock or material being blasted. However, these explosive materials, for safety of handling, are typically quite insensitive and require a substantial amount of energy or shock before they proceed to detonation or deflagration. Accordingly, within the explosive column in each bore, a detonator is placed at or near the bottom (and in some instances at intermediate positions) in the charge column. A detonator is typically comprised of a blasting cap and a primer or booster which is "cap-sensitive". Connected to the blasting cap is a wire which will carry an appropriate energy impulse, such as electricity, in order to initiate the cap. The cap in turn initiates a detonation process in the primer or booster (hereinafter "booster") material associated with it. The booster is of sufficient mass to provide the energy necessary to initiate the detonation of the explosive material in the bore hole column. Typically, a booster from between one-half to four pounds in weight is sufficient to initiate the detonation reaction in the bore hole.

Accordingly, the present invention relates to the utilization of excess Class 1.1 rocket propellant as the booster in a detonator system.

BEST MODE FOR CARRYING OUT THE INVENTION

One method of effectively using excess Class 1.1 solid rocket propellant involves the processing of excess uncured propellant by means of heating or otherwise curing the material in a size and form suitable for producing blocks of Class 1.1 boosters. For example, in the pouring of a solid rocket motor, several hundred pounds of excess material may remain in the mixing bowl after completely filling the motor case. The material remaining in the bowl may be poured into suitable containers or molds and then moved to the curing facilities along with the motor in order to produce Class 1.1 propellant product. In the past, the uncured material would typically have been placed in cans or containers and carefully removed to an open burn facility for destruction by burning. The principal objective of the present invention is to provide a useful product from a unique resource that would have otherwise been wasted.

After curing, the blocks of 1.1 solid rocket propellant may be further size reduced to blocks ranging from one-half to four pounds or more, depending upon the intended application. Normally, a small hole or recess must be created in the block of booster material where the blasting cap may be inserted. The blocks can then be individually wrapped and made available to explosive handlers and users in the blasting industry. The blasting operator will normally tape the wire from the blasting cap to the block of booster and lower this detonator assembly into a position at or near the bottom of the bore hole.

It has been found that the Class 1.1 solid rocket propellant material, which is widely used in a number of U.S. missile programs, has sufficient energy to act as a booster in a detonator assembly. Typically, these 1.1 materials contain nitroglycerin, an organic binder, an oxidizer and a fuel, such as particles of aluminum.

In a comparative test, a Class 1.1 rocket propellant was used as booster in a detonator system for initiating the blast of a bore hole system wherein the explosive charge column was comprised of ANFO. The 1.1 rocket propellant was comprised of 17.6% by wt nitroglycerin, 5.9% by wt polyethylene glycol, 18.0% by wt aluminum powder, 4.0% by wt ammonium perchlorate, 52.5% by wt HMX, 0.7% by wt isocyanate, 0.6% by wt carbon black and 0.6% by wt methyl nadic anhydride. This propellant was excess material from a rocket motor propellant casting operation commonly known in the industry as a reservoir. This excess cured-1.1-propellant, which was of substantially the same high quality propellant as the rocket motor, was then cut by a remotely operated guillotine knife into smaller blocks approximately 2"×2"×4". Each of these smaller blocks was then provided with a cavity approximately 3" deep and one-quarter inch across.

These blocks were packaged and furnished to the blasting contractor who utilized these blocks as the boosters in detonators. Standard, commercially-available, blasting caps were inserted into the booster cavity and by means of the connected wire a detonator was lowered into each of the bore holes in the conventional manner. Approximately 8 holes, 25 feed deep were provided with detonator assemblies using boosters of the present invention. Adjacent to these bore holes were another 8 bore holes of the same depth which were outfitted with detonators utilizing commercially available boosters. After placing the appropriate stemming in the upper portion of all bore holes in the two test systems, the blast was initiated.

It was found that the detonation velocity of the booster comprised of the 1.1 propellant of the present invention was approximately 25,000 feet per second; this was found to be a 4% improvement over the conventional TNT-PETN booster formulation used in the comparison test. Accordingly, the use of 1.1 solid rocket propellant material as a booster in detonator assemblies offers the blasting industry a quality product and conserves a valuable resource which would otherwise be wasted.

Although guillotine cutting was used in the above example, other mechanical cutting devices can be used such as knives, wires, saws and the like. In addition non-mechanical systems are available such as water-jet cutting and cryogenic fracturing for reducing the size of the propellant material to blocks as described above. In some instances it will be necessary, in order to facilitate handling, to cut the bulk propellant contained in the rocket motor, the reservoir, or the like into pieces of an intermediate size which can then be further reduced to block size.

A typical solid rocket motor to be demilitarized is usually comprised of an enclosure assembly of a central portion where the bulk of the propellant is contained inside a cylindrical case made of metal or composite material; the balance of enclosure assembly is a dome or forward closure as well as a nozzle assembly or aft closure which mate with the central portion. These forward and aft closures often contain propellant material as well that can be similarly removed to be used as booster material in detonator assemblies.

One method for removal of the bulk propellant from a rocket motor case is to cut it out in ribbons or strips from the inside. A rotating member is placed along the axis of the longitudinal perforation in the propellant grain and moved from the forward end to the aft end of the grain while a stirrup cutter affixed to the rotating member removes the propellant in ribbon-like pieces. These pieces can then be cut into blocks suitable for use as boosters as described above.

In some instances the Class 1.1 propellant may be smaller than block size such as a when the propellant is machined or drilled and chips or particles are produced. Also when cryogenic fracturing is used to reduce the size of the bulk propellant, some pieces may be smaller than block size. Such pieces can be assembled in a tube or other container in order to create a block of propellant with sufficient mass to perform as a booster.

Because Class 1.1 rocket propellant is an explosive which tends to detonate rather than deflagrate, any cutting or size modification activity must be performed remotely for personnel safety.

A suitable quantity of excess Class 1.1 propellant material is available for practice of the present invention by virtue of plans to demilitarize a large number of military propulsion systems. Instead of creating an environmental liability by burning or similarly disposing of these materials, their unique and highly-engineered explosive content can be used directly as a valuable resource. The blasting industry consumes many millions of pounds of explosive blasting agents and booster materials annually. Each demilitarized rocket motor system containing 1.1 propellant provides an opportunity to utilize the teachings of the present invention to directly use the finished propellant product contained in such rocket motors as a booster product for the blasting industry.

While the present invention has described a preferred embodiment, variations to the basic concepts disclosed herein will be apparent to those skilled in the art, and such are intended to be within the scope of the invention as set forth in the following claims.

What is claimed is:

1. A method for detonating an explosive charge comprising a detonator formed of a cap and a booster, and an explosive charge wherein the detonator is positioned in close proximity to the explosive charge such that upon ignition of the detonator the energy is sufficient to cause the explosive to detonate, the improvement comprising a booster formed of 1.1 solid rocket propellant material.

2. The method of claim 1 wherein the booster is in the form of single block of 1.1 rocket propellant material.

3. The method of claim 1 wherein the booster is in the form of a plurality of particles of 1.1 solid rocket propellant material.

4. The method of claim 1 wherein the booster contains about 0.5 pounds to about 4.0 pounds of 1.1 solid rocket propellant material.

5. A detonator for use in detonating explosive charges comprising a blasting cap and a booster wherein said booster is 1.1 solid rocket propellant material.

6. The detonator of claim 5 wherein the 1.1 solid rocket propellant is a unitary block of material.

7. The detonator of claim 5 wherein the 1.1 solid rocket propellant material is comprised of a plurality of particles of 1.1 propellant.

8. The detonator of claim 5 wherein the amount of 1.1 solid rocket propellant is from about 0.5 pounds to about 4 pounds.

9. A method for the use of excess 1.1 propellant as product in the blasting industry which propellant might otherwise become an environmental liability comprising the steps of:

providing excess 1.1 solid rocket propellant;

reducing the size of the class 1.1 propellant to blocks of a size and geometry suitable for an explosive booster; and utilizing said blocks as a booster in an initiating system for explosives.

10. A method as in claim 9 wherein the excess 1.1 propellant is provided from a solid rocket motor comprised of an enclosure assembly and class 1.1 solid rocket propellant contained therein.

11. A method as in claim 10 wherein the size of the propellant is reduced to suitable size and geometry by first reducing the size of the bulk propellant in the motor by cutting it into pieces of a predetermined size larger than said blocks.

12. A method as in claim 11 wherein the cutting of the propellant into pieces of predetermined sizes is accomplished by mechanical cutting means such as wire, knife, guillotine or saw.

13. A method as in claim 11 wherein the cutting of the propellant into pieces of predetermined sizes is accomplished by water jet cutting.

14. A method as in claim 11 wherein the cutting of the pieces into predetermined sizes is accomplished by cryogenic fracturing.

15. A method as in claim 9 wherein the excess 1.1 propellant is in the form of uncured propellant which is first cured in containers or molds of a predetermined configuration.

16. A method as in claim 15 wherein said predetermined configuration is of the size and geometry suitable for use as an explosive booster.

17. A method as in claim 9 wherein the excess 1.1 propellant is cured propellant that results from rocket motor manufacturing activities such as reservoirs.

18. A method for the use of excess 1.1 propellant as product in the blasting industry which propellant might otherwise become an environmental liability comprising the steps of:

providing excess 1.1 solid propellant in chip or particle pieces which individual pieces have a weight less than that suitable for use as a booster;

assembling such pieces in a suitable container to create a combined size and geometry suitable for use as a booster; and utilizing said blocks as a booster in an initiating system for explosives.

19. A method as in claim 18 wherein the chip or particle pieces are from machining cured class 1.1 propellant.

20. A method as in claim 18 wherein the chip or particle pieces are from cryogenic fracturing.

* * * * *

UNITED STATES PATENT AND TRADEMARK OFFICE

CERTIFICATE OF CORRECTION

PATENT NO. : 5,291,831

DATED : March 8, 1994

INVENTOR(S) : Patrick L. Carney and Robert W. Perry

It is certified that error appears in the above-identified patent and that said Letters Patent is hereby corrected as shown below:

Col. 1, Line 46, "his" should read -- is --.

Col. 3, Line 14, "feed" should read -- feet --.

Signed and Sealed this

Thirteenth Day of December, 1994

Bruce Lehman

*Attest:*

BRUCE LEHMAN

*Attesting Officer*

*Commissioner of Patents and Trademarks*